US007207907B2

(12) United States Patent
Guenther et al.

(10) Patent No.: US 7,207,907 B2
(45) Date of Patent: Apr. 24, 2007

(54) BALL BAT HAVING WINDOWS

(75) Inventors: Douglas G. Guenther, Wheaton, IL (US); Bradley L. Gaff, Portland, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 11/146,991

(22) Filed: Jun. 7, 2005

(65) Prior Publication Data

US 2006/0276275 A1 Dec. 7, 2006

(51) Int. Cl.
*A63B 59/06* (2006.01)

(52) U.S. Cl. ..... 473/566; 473/564; 473/567

(58) Field of Classification Search ..... 473/564–568, 473/457, 519, 520
See application file for complete search history.

(56) References Cited

U.S. PATENT DOCUMENTS

| | | | | |
|---|---|---|---|---|
| 59,313 | A | 10/1866 | Hill | |
| 729,639 | A * | 6/1903 | McCoy | 473/520 |
| 1,025,478 | A * | 5/1912 | Murphy | 473/568 |
| 3,173,688 | A | 3/1965 | Green | 273/72 |
| 3,246,894 | A | 4/1966 | Salisbury | 273/26 |
| 4,834,376 | A * | 5/1989 | Steinberg | 473/457 |
| 5,131,651 | A * | 7/1992 | You | 473/520 |
| 5,150,897 | A | 9/1992 | Wortman | 273/72 |
| 5,179,255 | A * | 1/1993 | Yeh | 181/182 |
| 5,273,278 | A | 12/1993 | Becker | 273/29 |
| 5,360,209 | A | 11/1994 | Mollica | 273/26 |
| 5,516,097 | A | 5/1996 | Huddleston | 273/26 |
| 5,766,104 | A | 6/1998 | Albarelli, Jr. | 473/567 |
| D399,545 | S | 10/1998 | Albarelli, Jr. | D21/211 |
| 6,048,283 | A | 4/2000 | Albarelli, Jr. | 473/567 |
| 6,485,382 | B1 * | 11/2002 | Chen | 473/566 |
| 6,612,945 | B1 * | 9/2003 | Anderson | 473/566 |
| 6,702,698 | B2 | 3/2004 | Eggiman et al. | 473/566 |
| 6,743,127 | B2 | 6/2004 | Eggiman et al. | 473/567 |
| 2004/0077439 | A1 | 4/2004 | Eggiman et al. | 473/567 |
| 2004/0162167 | A1 | 8/2004 | Stevens et al. | 473/457 |

* cited by examiner

*Primary Examiner*—Mark S. Graham
(74) *Attorney, Agent, or Firm*—Terence P. O'Brien

(57) ABSTRACT

A bat extending along a longitudinal axis and configured for impacting a baseball or softball in competitive play includes a handle portion coupled to a barrel portion. The handle portion has a distal end and includes a tubular tapered region positioned adjacent the distal end. The tapered region has a peripheral outer surface encircling the longitudinal axis and includes at least one window formed into the outer surface. The one or more windows can be defined by a latticework.

18 Claims, 8 Drawing Sheets

BALL BAT HAVING WINDOWS

FIELD OF THE INVENTION

The present invention relates generally to ball bats. In particular, the present invention relates to a bat configured for impacting a baseball or a softball during competitive play, wherein at least one window is formed into the outer surface of the bat.

BACKGROUND OF THE INVENTION

Ball bats, such as baseball and softball bats, are well known. In recent years, metallic bats including a tubular handle portion and a tubular barrel portion have emerged providing improved performance and improved durability over crack-prone wooden bats. The most common tubular bat is the aluminum single-wall tubular bat. Such bats have the advantage of a generally good impact response, meaning that the bat effectively transfers power to a batted ball.

Generally speaking, bat performance is a function of the weight of the bat, the size, and the impact response of the bat. The durability of a bat relates, at least in part, to its ability to resist denting and depends on the strength and stiffness of the tubular bat frame. While recent innovations in bat technology have increased performance and durability, most new bat designs typically improve performance or durability at the expense of the other because of competing design factors. For example, an attempt to increase the durability of the bat often produces an adverse effect on the bat's performance.

The incorporation of these advances and the use of additional materials, such as, other aluminum alloys, titanium alloys and composite materials have resulted in a large variety of well-performing ball bats. A typical metal bat, such as an aluminum bat, is formed with a one piece integral frame. Recently, high performance bats, such as bats incorporating the DeMarini® Half and Half™ bat technology, have been formed with separate handle and barrel portions, wherein the handle portion can be formed of a first material, such a composite material, and the barrel portion can be formed of a second material, such as a metal or a different composite material.

One drawback of recent ball bats formed of aluminum, titanium or composite materials is their cost. Aluminum, titanium and composite materials generally have a high material cost. For example, aluminum can cost up to ten times the price of conventional steel, and titanium is significantly more expensive than aluminum.

Despite such advances in ball bat design and materials, a continuing need exists to further improve and optimize the performance, durability, feel and appearance of existing bats. It would be advantageous to optimize the weight distribution of a ball bat by removing or transferring material from one or more locations on the bat and redistributing, some or all of the weight of the removed material, to other more desirable locations. A need exists for design features that reduce the cost of a high performance ball bat without negatively affecting performance or durability of the ball bat. It would also be advantageous to produce a high performance ball bat with innovative design features that significantly improve the appearance of the ball bat without negatively affecting the performance of the ball bat. A need also exists for a ball bat that provides the batter with enhanced feedback during use.

SUMMARY OF THE INVENTION

The present invention provides a bat extending along a longitudinal axis and configured for impacting a baseball or softball in competitive play. The bat includes a handle portion coupled to a barrel portion. The handle portion has a distal end and includes a tubular tapered region positioned adjacent the distal end. The tapered region has a peripheral outer surface encircling the longitudinal axis and includes at least one window formed into the outer surface.

According to a principal aspect of the invention, a bat extends along a longitudinal axis and is configured for impacting a baseball or softball in competitive play. The bat includes a handle portion coupled to a barrel portion. The handle portion has a peripheral outer surface encircling the longitudinal axis and a plurality of openings formed into the outer surface. The plurality of openings extending over at least 5 percent of the outer surface area of the handle portion.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
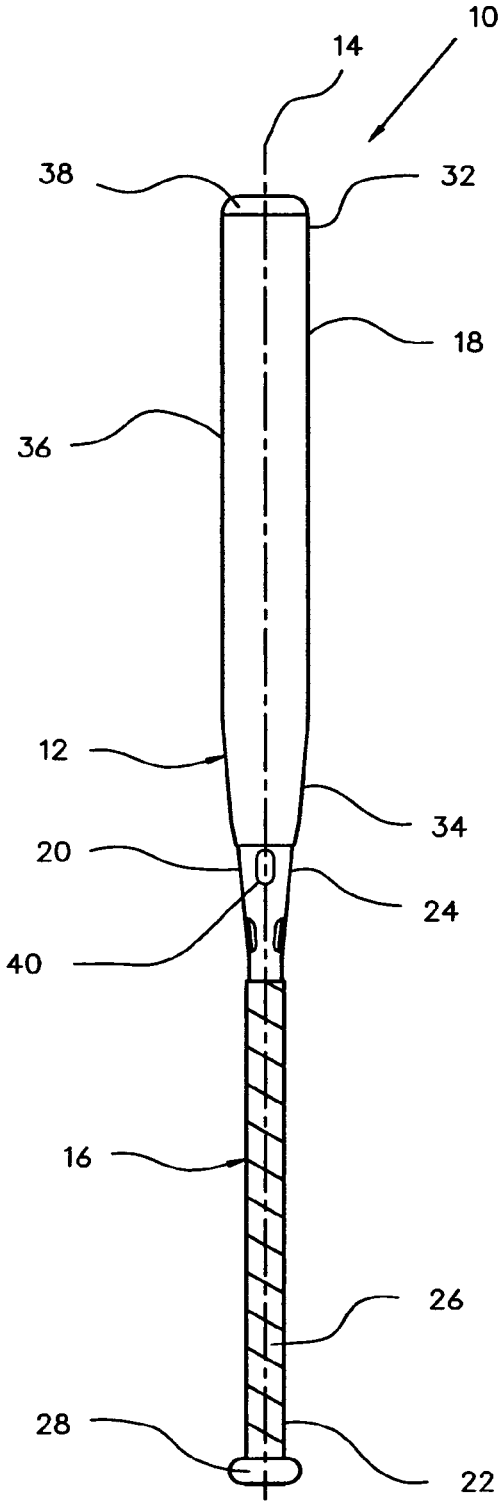
FIG. 1 is a first side view of a bat in accordance with a preferred embodiment of the present invention.
Figure 2:
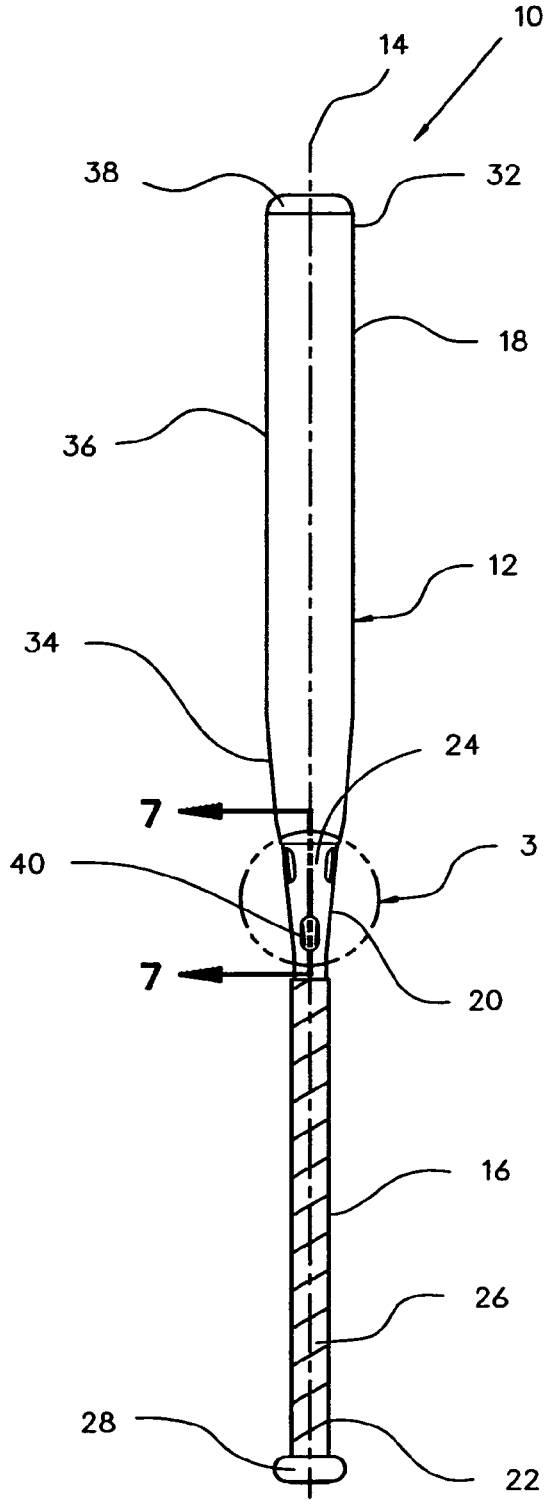
FIG. 2 is a second side view of the bat of FIG. 1.

Referring to FIGS. 1 and 2, a ball bat is indicated generally at 10. The ball bat 10 of FIGS. 1 and 2 is configured as a softball bat; however, the invention can also be formed as a baseball bat, a rubber ball bat, or other form of ball bat. The bat 10 includes a frame 12 extending along a longitudinal axis 14. The frame 12 has a relatively small diameter handle portion 16, a relatively larger diameter barrel portion 18 (also referred as a hitting or impact portion), and an intermediate tapered region 20. The intermediate tapered region 20 can be formed by the handle portion 16, the barrel portion 18 or a combination thereof.

In one preferred embodiment, the handle and hitting portions 16 and 18 of the frame 12 are formed as separate structures, which are connected or coupled together. This multi-piece frame construction enables the handle portion 16 to be formed of one material, and the barrel portion 18 to be formed of a second, different material. In an alternative preferred embodiment, the frame 12 can be a one-piece integral structure (see FIG. 13).

The handle portion 16 is an elongate structure having a proximal end region 22 and a distal end region 24, which extends along, and diverges outwardly from, the axis 14 outwardly projecting from and along the axis 14 to form a substantially frusto-conical shape for connecting or coupling to the barrel portion 18. Preferably, the handle portion 16 is sized for gripping by the user and includes a grip 26, which is wrapped around and extends longitudinally along the handle portion 16, and a knob 28 connected to the proximal end 22 of the handle portion 16. The handle member 16 is formed of a strong, generally flexible, lightweight material, preferably a composite material. Alternatively, the handle portion 16 can be formed of other materials such as aluminum, plastic, or wood. In other alternative embodiments, heavier materials such as other metals and steels can be used.

The barrel portion 18 of the frame 12 is "tubular," "generally tubular," or "substantially tubular," each terms intended to encompass softball style bats having a substantially cylindrical impact portion (or "barrel") as well as baseball style bats having a generally frusto-conical barrel. The barrel portion 18 extends along the axis 14 and has a distal end region 32, a proximal end region 34, and a central region 36 disposed between the distal and proximal end regions 32 and 34. The proximal end region 34 converges toward the axis 14 in a direction toward the proximal end of the barrel portion 18 to form a frusto-conical shape that is complementary to the shape of the distal end region 24 of the handle portion 16. The barrel portion 18 can be directly connected to the handle portion 16. The connection can involve a portion, or substantially all, of the distal end region 24 or tapered region 20 of the handle portion 16 and the proximal end region 34 of the barrel portion 18. Alternatively, an intermediate member can be used to space apart and/or attach the handle portion 16 to the barrel portion 18. The intermediate member can space apart all or a portion of the barrel portion 16 from the handle portion 16, and it can be formed of an elastomeric material, an epoxy, an adhesive, a plastic or any conventional spacer material. The bat 10 further includes an end cap 38 attached to the distal end 32 of the barrel portion 18 to substantially enclose the distal end 32.

The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches.

Figure 3:
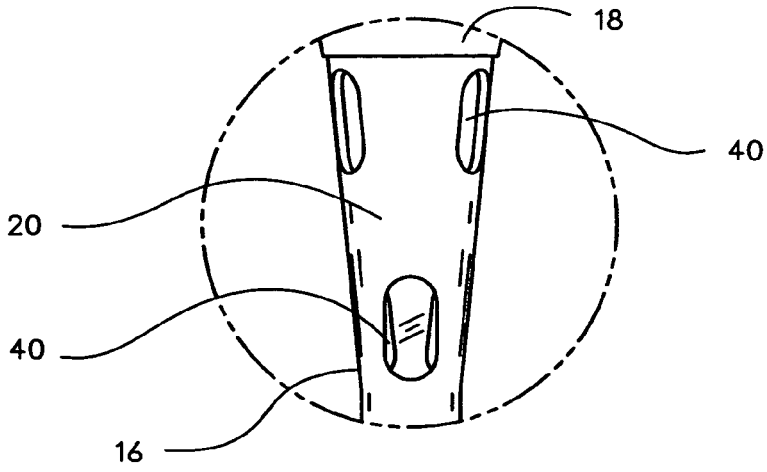
FIG. 3 is an enlarged view of a tapered region of a handle portion of the bat taken from circle 3 of FIG. 2.

Referring to FIGS. 1–3, in one preferred embodiment, the tapered region 20 of the handle portion 16 can include one or more windows 40. For the purposes of this application, the term "window" generally refers to an opening constructed in a wall, such as the wall of the handle portion, tapered region or barrel portion of the bat frame. The opening can be a through-wall opening or a recess extending through a portion of the wall thickness of the frame. The window preferably has a curved, cylindrical, tubular or frusto-conical contour or outline. Alternatively, the window can be generally planar or have a generally planar outline. The window can include a framework defining the opening. The window also can include a covering (or a curved pane) positioned within or over the opening. The covering can be fixedly, removably or replaceably secured to the frame of the bat.

In one particularly preferred embodiment, the tapered region 20 includes six windows 40 formed into its outer surface. The windows 40 are generally oval-shaped, and are radially and/or longitudinally spaced apart from each other. Each window has a length of approximately one inch and a width of approximately 0.5 inch. Accordingly, the windows can have an area of approximately 0.5 $in^2$. In alternative preferred embodiments, the windows can be formed in sizes above and below 0.5 $in^2$. For example, bats having window sizes of approximately 0.25 $in^2$, 1.0 $in^2$, 2.0 $in^2$ and 3.0 $in^2$ are contemplated under the present invention. As described further below, in alternative preferred embodiments other quantities, sizes and shapes of windows can also be incorporated into the ball bat.

The windows 40 can be through-wall enabling air and light to pass entirely through the tapered region 20 of the bat 10. The windows 40 can also produce a unique audible sound when swung in the air. The sound varies with swing speed, thereby enabling a batter to gauge his or her swing speed by simply listening to the bat as it is swung. This audible feedback is immediate and repeatable, thereby enabling a batter to quickly, efficiently and cost effectively evaluate her or her swing at any time during the bat's use. Further, the windows provide the bat with a unique, aesthetically pleasing appearance.

The windows 40 are preferably formed in the tapered region 20 of the bat 10, but can also be positioned at other locations. Placement in the tapered region 20 advantageously allows for material (and the weight of such material) to be removed from the tapered region 20. The removed weight can be redistributed to other locations about the bat or removed entirely. Formation of the windows in the tapered region 20 can make the tapered region lighter and more flexible, thereby improving the performance of the bat. The removal of material to form the windows can also result in a reduction in the bat's moment of inertia ("MOI"), thereby increasing a batter's ability to swing or otherwise move the bat. The removed material can also lower the material cost of the bat.

Figure 4:
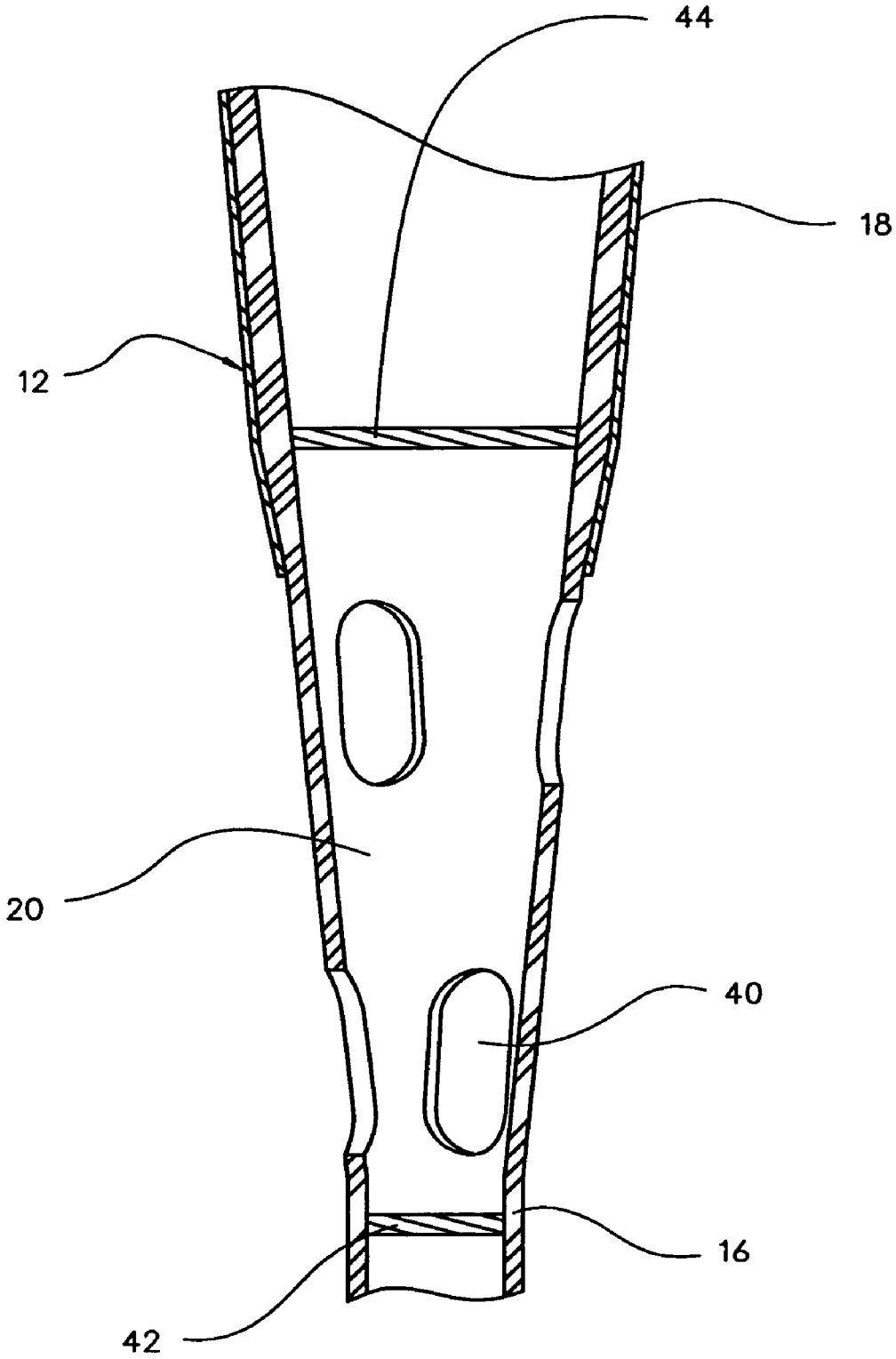
FIG. 4 is an enlarged longitudinal cross-sectional view of the tapered region of the handle portion and a proximal end of a barrel portion of the ball bat of FIG. 1.

Referring to FIG. 4, the tapered region 20 is shown in greater detail. When the window 40 is formed as a through wall opening, the tapered region 20 is open to air, light, debris and moisture. Accordingly, to inhibit debris and moisture form entering the remaining regions of the bat 10, the tapered region 20 can further includes first and second caps 42 and 44. The caps 42 and 44 are discs coupled to the inner surface of the frame 12 to generally isolate the inner volume of the tapered region 20 from other regions or portions of the bat. The first cap 42 generally isolates the inner volume of the tapered region 20 from the remaining sections of the handle portion 16, and the second cap 44 generally isolates the inner volume of the tapered region 20 from the barrel portion 18.

Alternatively, the caps 42 and 44 can be formed into one or more other shapes, such as, for example, cup-like, conical, hemispherical, convoluted, planar, irregular and combinations thereof. The caps 42 and 44 are preferably formed of a lightweight material, such as a plastic. Alternatively, other materials, such as paper, polymer foams, sponge-like materials can also be used. The caps 42 and 44 are preferably adhesively attached to the inner surface of the frame. Alternatively, the caps 42 and 44 can be attached through other conventional means. The caps 42 and 44 can be fixedly or removably secured to the inner surface of the frame 10. The thickness of the caps 42 and 44 can also vary depending upon the bat's application, and the material used to form the caps. In an alternative preferred embodiment, the bat can be formed without one or both of the first and second caps.

Figure 5:
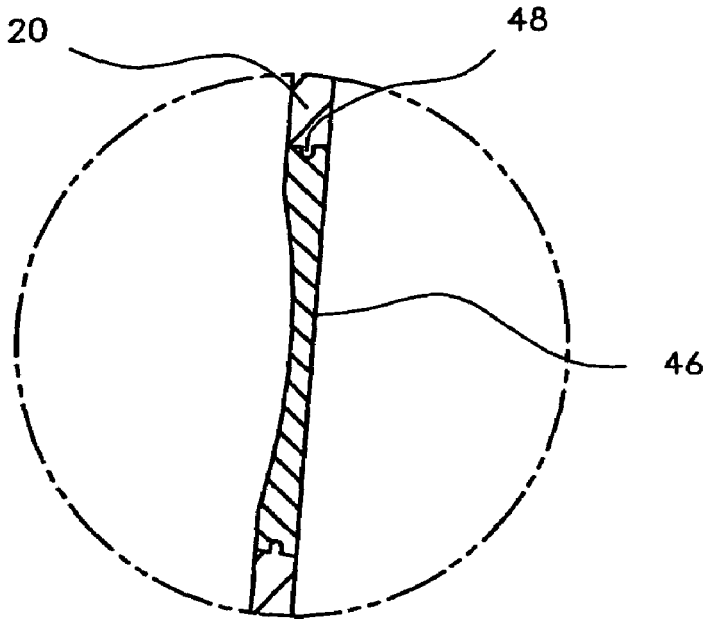
FIG. 5 is an enlarged longitudinal cross-sectional view of a window formed in the tapered region of the handle portion in accordance with an alternative preferred embodiment of the present invention.

Referring to FIG. 5, in an alternative preferred embodiment of the present invention, the window 40 can include a covering 46 positioned within the opening of the window 40. The covering 46 is a curved element, or otherwise formed, to correspond to the shape of the opening of the window 40. The covering 46 is fixedly secured to edges of the tapered region 20 defining the window 40. Preferably, the covering 46 is fixedly secured through the use of an adhesive in combination with a snap-fit connection. The edges of the tapered region 20 can include a ridge 48 for facilitating the snap-fit connection of the covering 46 to the tapered region 20. In alternative preferred embodiments, the covering 46 can be secured to the tapered region through other conventional means, such as, for example, thermal bonding or fasteners. Further, the covering can be formed with a ridge or equivalent structure and the edges of the tapered region can be configured to correspond with the ridge. Alternatively, the covering can be removably installed within the window.

The covering 46 is formed of a lightweight durable material, preferably a thermoplastic material. Alternatively, the covering can be formed of other materials, such as, for example, other plastics, other polymeric materials, tempered glass, ceramics, a composite material or combinations thereof. Preferably, the covering 46 is formed of a material that is transparent, translucent, semi-transparent or semi-translucent, thereby enabling light to pass into and through the bat. Such a configuration, also enables a user to see inside the bat. Accordingly, the window 40, and/or windows with the coverings 46, can enable a user to view other technology within the ball bat. For example, the windows 40 and coverings 46 can be used to enable a user to view the configuration of an insert within the barrel portion of the bat, or a specific composite layup on the inner surface of the bat. The coverings 46 can be tinted, and single or multi-colored. The coverings 46 also can include alphanumeric indicia, designs, logos, trademarks, product instructions, or other types of markings.

Figure 6:
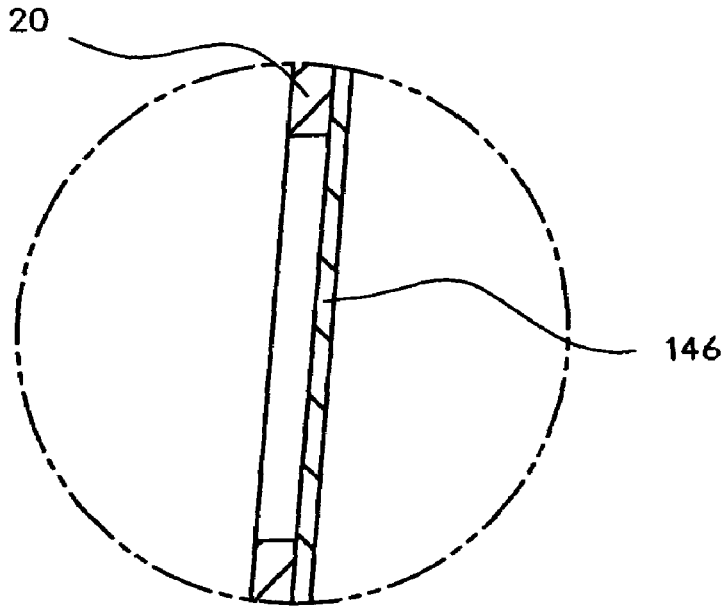
FIG. 6 is an enlarged longitudinal cross-sectional view of the window formed in the tapered region of the handle portion in accordance with another alternative preferred embodiment of the present invention.

Referring to FIG. 6 in another alternative preferred embodiment, the covering 146 can be an outer layer of material, or coating, which extends over the opening of the window 40 and can also extend over the outer surface of the tapered region 20. In this configuration, the covering 146 does not necessarily contact the inner edge surfaces defining the opening of the window 40. The covering 146 can be applied to the outer surface of the intermediate region 20 in a fluid state and cured as a solid layer. The covering 146 is preferably formed of a material as described above for the covering 46. Like the covering 46, the covering 146 can also be transparent, semi-transparent, translucent, semi-translucent, colored, tinted or a combination thereof.

Figure 7:
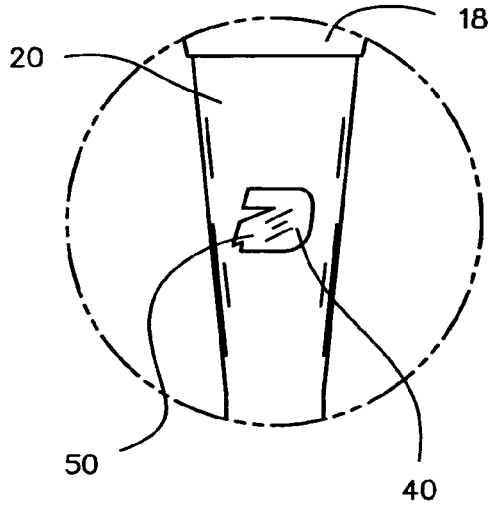
FIG. 7 is an enlarged view of the tapered region of the handle portion of the bat in accordance with another alternative preferred embodiment of the present invention.
Figure 8:
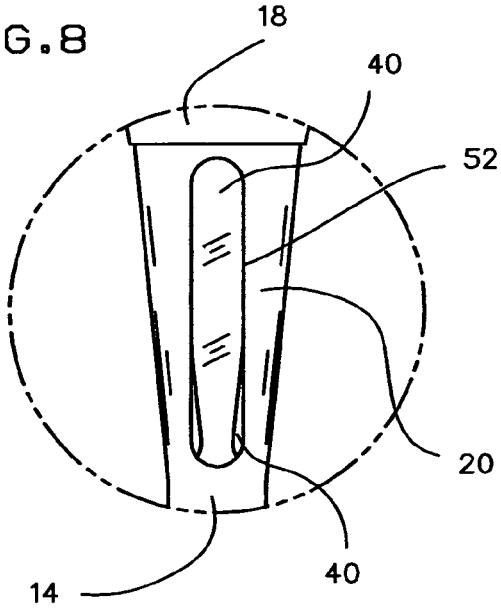
FIG. 8 is an enlarged view of the tapered region of the handle portion of the bat in accordance with another alternative preferred embodiment of the present invention.

Referring to FIGS. 7 and 8, in alternative preferred embodiments, the window 40 can be formed into a large variety of different shapes. In one preferred embodiment, as shown in FIG. 7, the opening of the window 40 can be formed in the shape of a trademark 50 (such as the DeMarini® "D™") or a logo. In another alternative preferred embodiment, as shown in FIG. 8, the window 40 can be configured as an elongate oval opening 52. In additional alternative preferred embodiments, the window can be formed in a shape that is circular, triangular, rectangular, polygonal, spiral, any closed-curved shape, irregular, and combinations thereof. A single window can be used or multiple windows. The windows can be of uniform shape or can be formed in a variety of different shapes (see FIG. 13). The windows can also be formed in the shape of alphanumeric characters or designs.

Figure 10:
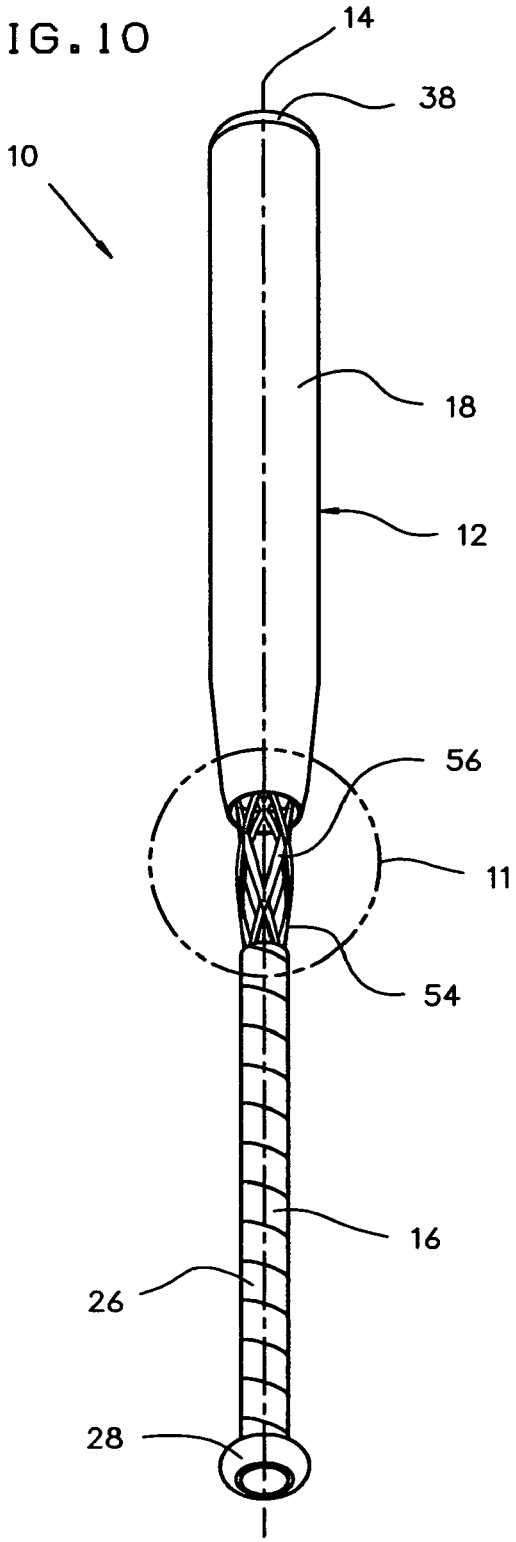
FIG. 10 is a side perspective view of the handle portion of FIG. 9 incorporated into an assembled ball bat in accordance with one alternative preferred embodiment of the present invention.
Figure 9:
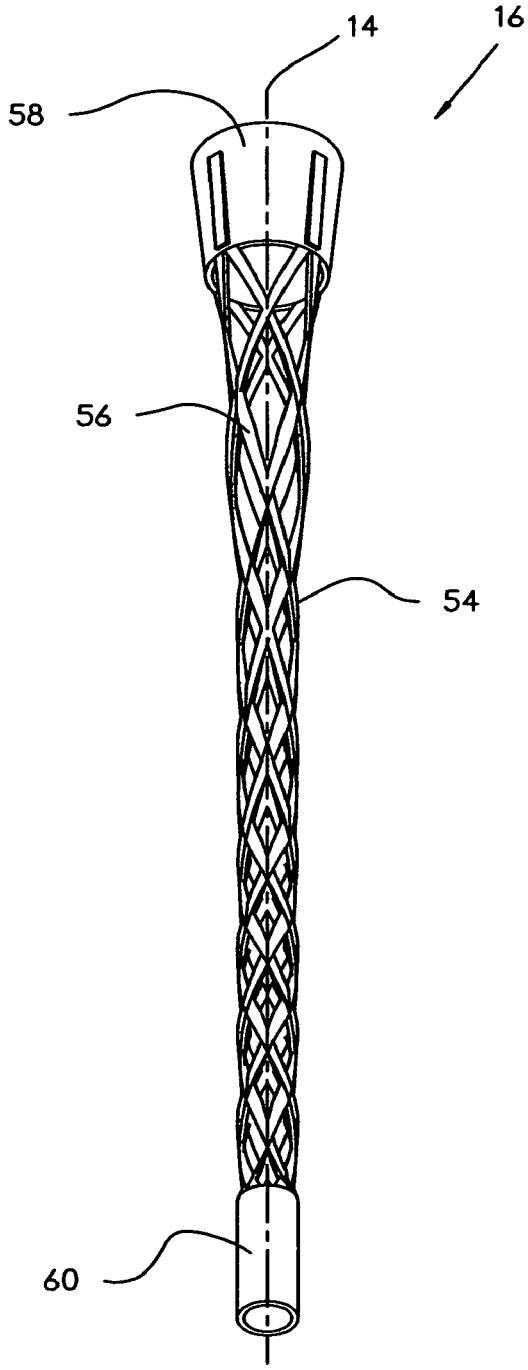
FIG. 9 is a side perspective view of a handle portion of a ball bat in accordance with an alternative preferred embodiment of the present invention.
Figure 11:
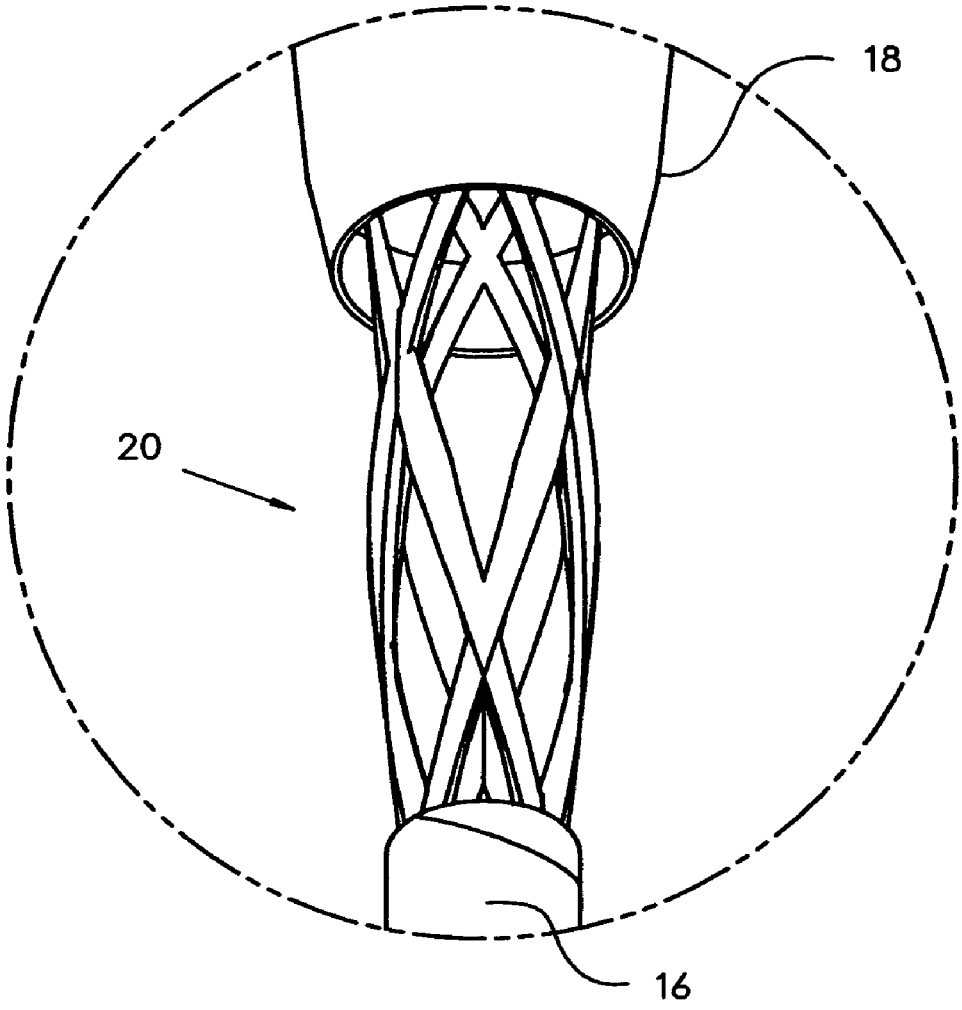
FIG. 11 is an enlarged view of the tapered region of the bat of FIG. 10.

Referring to FIGS. 9–11, in another alternative preferred embodiment, the handle portion 16 of the bat 10 can include a latticework 54. The latticework 54 can have a general tubular shape resembling the shape of a conventional handle portion of a ball bat. The latticework 54 includes a plurality of elongate strips 56 interwoven to produce an open pattern or weave positioned between a distal coupling member 58 and a proximal member 60. The latticework 54 also provides the advantages of the windows 40 described above. The latticework 54 generally requires less material thereby increasing the design flexibility of the bat. The latticework 54 provides a unique, pleasing, attractive appearance. The open pattern or weave of the latticework 54 enables light and air to pass through the handle portion 16. The latticework 54 can produce a unique sound that varies with the bat's swing speed. The latticework 54 can also result in a reduced moment of inertia. Although FIG. 9 illustrates the latticework 54 extending over a large percentage of the handle portion 16, in alternative preferred embodiments, the latticework can extend over a small or larger region or percentage of the handle portion. The latticework 54 can also be incorporated into a region of the barrel portion of the bat.

Figure 12:
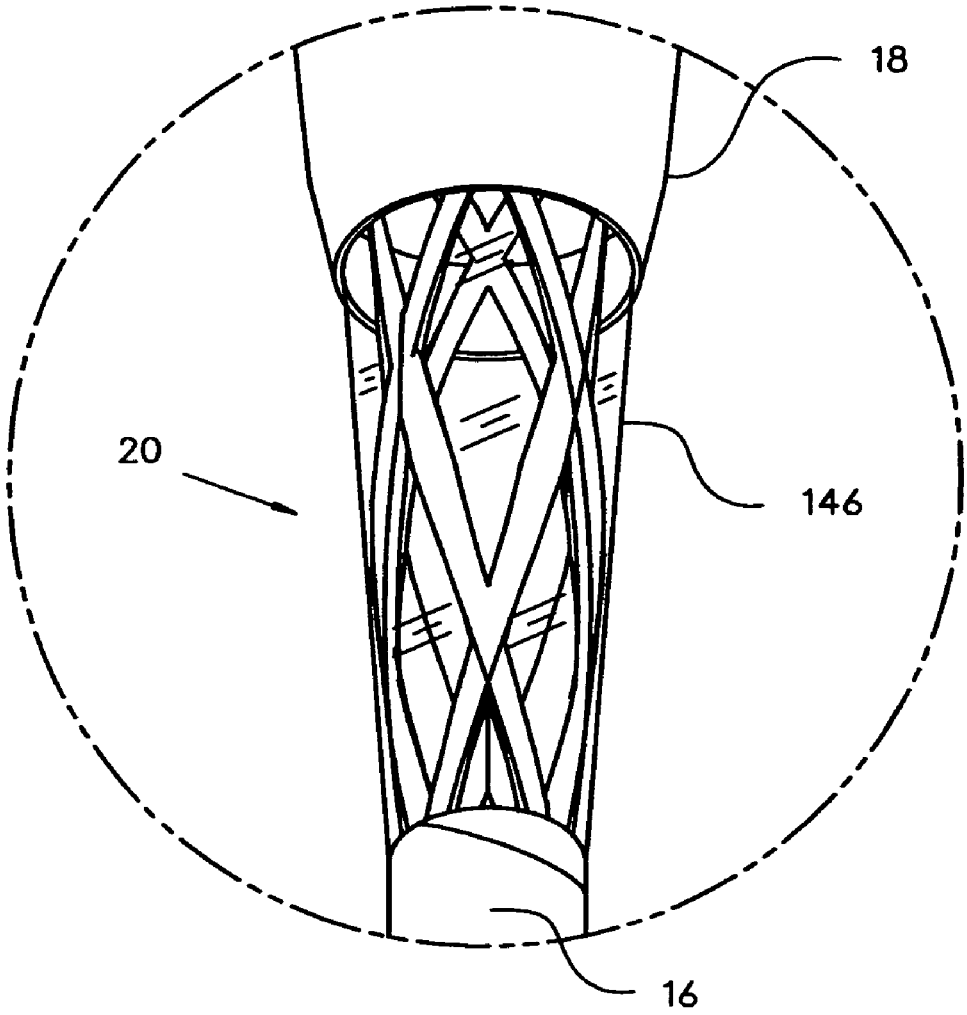
FIG. 12 is an enlarged view of the tapered region of the handle portion of the bat in accordance with another alternative preferred embodiment of the present invention.

Referring to FIG. 12, in another alternative preferred embodiment, the outer peripheral surface of the latticework 54 can include a covering 146. The covering 146 can be positioned to overlay the latticework 54 or to extend into the openings formed by the opening weave of the latticework 54. The covering 146 is substantially the same as the covering 46.

Figure 13:
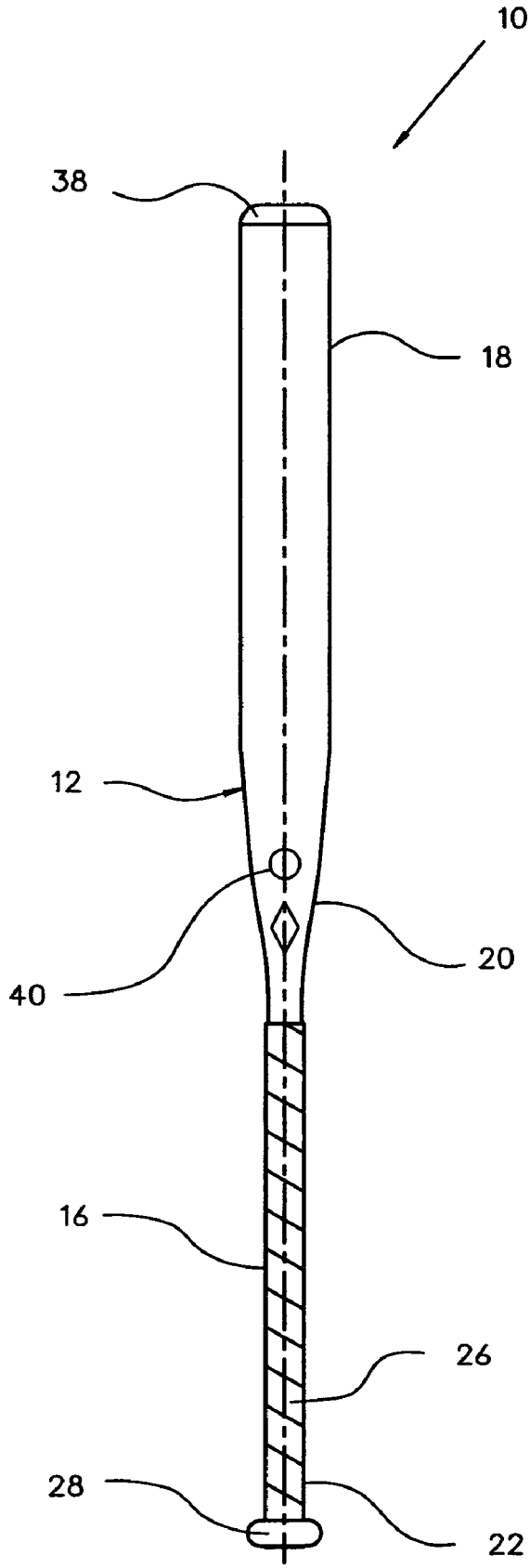
FIG. 13 is a side view of a bat having a one piece frame in accordance with another alternative preferred embodiment of the present invention.

Referring to FIG. 13, in another alternative preferred embodiment, the frame 12 can be an integrally formed elongate body combining the barrel portion 18, the handle portion 12 and the tapered region 20 into a single piece structure. FIG. 13, also illustrates the use of windows 40 having alternative shapes and sizes.

While there have been illustrated and described preferred embodiments of the present invention, it should be appreciated that numerous changes and modifications may occur to those skilled in the art and it is intended in the appended claims to cover all of those changes and modifications which fall within the spirit and scope of the present invention.

What is claimed is:

1. A non-wooden bat extending along a longitudinal axis and configured for impacting a baseball or softball in competitive play, the bat comprising:

a handle portion having a distal end, the handle portion including a hollow tubular tapered region approximate the distal end, the tubular tapered region being generally unfilled and having a peripheral outer surface encircling the longitudinal axis, the tapered region formed by a one-piece tubular wall and defining at least one window, the window extending entirely through the tubular wall and having a size of at least 0.5 $in^2$, the tubular wall having a generally uniform wall thickness;

a barrel portion coupled to the handle portion; and at least one covering positioned in or over the window, the covering being formed of a material selected from the group consisting of a translucent material, a semi-translucent material, a transparent material, a semi-transparent material, and combinations thereof.

2. The bat of claim 1, wherein each window has a size of at least 1 $in^2$.

3. The bat of claim 1, wherein the window is formed into a shape consisting of a trademark.

4. The bat of claim 1, wherein the window is formed into a shape selected from the group consisting of a circle, an oval, a square, a triangle, other polygonal shapes, other closed curved shapes and irregular closed shapes.

5. The bat of claim 1, wherein the at least one covering is fixedly connected to the tapered region of the handle portion.

6. The bat of claim 1, wherein the covering is formed of a material selected from the group consisting of a plastic, a polyurethane, and other polymeric material.

7. The bat of claim 1, wherein the at least one layer of material is shaped to generally correspond to the shape of the window.

8. A non-wooden bat extending along a longitudinal axis and configured for impacting a baseball or softball in competitive play, the bat comprising:

a handle portion having a distal end, the handle portion including a hollow tubular tapered region approximate the distal end, the tubular tapered region being generally unfilled and having a peripheral outer surface encircling the longitudinal axis, the tapered region formed by a one-piece tubular wall and defining at least one window, the window extending entirely through the tubular wall and having a size of at least 0.5 $in^2$, the tubular wall having a generally uniform wall thickness;

a barrel portion coupled to the handle portion; and a first cap coupled to the handle portion and configured to inhibit debris entering through the window from extending to remaining regions of the handle portion.

9. The bat of claim 8, further comprising a second cap coupled to one of the handle portion and the barrel portion, wherein the second cap is configured to inhibit debris entering through the window from extending into the barrel portion.

10. A non-wooden bat extending along a longitudinal axis and configured for impacting a baseball or softball in competitive play, the bat comprising:

a handle portion having a distal end, the handle portion including a hollow tubular tapered region approximate the distal end, the tubular tapered region being generally unfilled and having a peripheral outer surface encircling the longitudinal axis, the tapered region formed by a one-piece tubular wall and defining at least one window, the window extending entirely through the tubular wall and having a size of at least 0.5 $in^2$, the tubular wall having a generally uniform wall thickness;

a barrel portion coupled to the handle portion, the at least one window being defined by a lattice structure.

11. A non-wooden bat extending along a longitudinal axis and configured for impacting a baseball or softball in competitive play, the bat comprising:

a handle portion including a hollow, tubular tapered region and having a peripheral outer surface encircling the longitudinal axis, the tapered region being generally unfilled, being formed by a one-piece tubular wall and defining at least one opening, the at least one opening extending entirely through the tubular wall and over at least 5 percent of the outer surface area of the handle portion;

a barrel portion coupled to the handle portion; and at least one covering positioned in or over the at least one opening, the at least one covering shaped, individually or collectively, to generally correspond to the shape of the at least one opening, the handle portion comprising a latticework.

12. The bat of claim 11, wherein the latticework is a tubular latticework.

13. A non-wooden bat extending along a longitudinal axis and configured for impacting a baseball or softball in competitive play, the bat comprising:

a handle portion including a hollow, tubular tapered region and having a peripheral outer surface encircling the longitudinal axis, the tapered region being generally unfilled, being formed by a one-piece tubular wall and defining at least one opening, the at least one opening extending entirely through the tubular wall and over at least 5 percent of the outer surface area of the handle portion;

a barrel portion coupled to the handle portion; and at least one covering positioned in or over the at least one opening, the at least one covering shaped, individually or collectively, to generally correspond to the shape of the at least one opening, the covering being formed of a material selected from the group consisting of a translucent material, a semi-translucent material, a transparent material, a semi-transparent material, and combinations thereof.

14. The bat of claim 13, wherein the covering is formed of a material selected from the group consisting of a plastic, a polyurethane, and other polymeric material.

15. The bat of claim 13, wherein the at least one opening extends over at least 20 percent of the outer surface area of the handle portion.

16. The bat of claim 13, wherein the at least one layer of material is shaped to generally correspond to the at least one opening.

17. The bat of claim 13, wherein one or more of the at least one openings are shaped in the form of a trademark.

18. A non-wooden bat extending along a longitudinal axis and configured for impacting a baseball or softball in competitive play, the bat comprising:

a handle portion including a hollow, tubular tapered region and having a peripheral outer surface encircling the longitudinal axis, the tapered region being generally unfilled, being formed by a one-piece tubular wall and defining at least one opening, the at least one opening extending entirely through the tubular wall and over at least 5 percent of the outer surface area of the handle portion;

a barrel portion coupled to the handle portion;

at least one covering positioned in or over the at least one opening, the at least one covering shaped, individually, or collectively, to generally correspond to the shape of the at least one opening; and a cap coupled to one of the handle portion and the barrel portion, the cap being configured to inhibit debris entering through the window from extending into the barrel portion.

* * * * *